US010142730B1

(12) United States Patent
Yousefian et al.

(10) Patent No.: US 10,142,730 B1
(45) Date of Patent: Nov. 27, 2018

(54) TEMPORAL AND SPATIAL DETECTION OF ACOUSTIC SOURCES

(71) Applicant: Cirrus Logic International Semiconductor Ltd., Edinburgh (GB)

(72) Inventors: Nima Yousefian, Tempe, AZ (US); Seth Suppappola, Tempe, AZ (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/714,262

(22) Filed: Sep. 25, 2017

(51) Int. Cl.
*H04R 3/00* (2006.01)
*H04R 3/04* (2006.01)
*H04R 1/40* (2006.01)

(52) U.S. Cl.
CPC ..... *H04R 3/005* (2013.01); *H04R 1/406* (2013.01); *H04R 3/04* (2013.01); *H04R 2201/401* (2013.01)

(58) Field of Classification Search
CPC ..... H04R 1/406; H04R 3/005; H04R 3/04; H04R 2201/401
USPC ..... 381/92
See application file for complete search history.

(56) References Cited

U.S. PATENT DOCUMENTS 6,912,178 B2 * 6/2005 Chu ..... G01S 5/18 348/E7.079
8,515,093 B2 * 8/2013 Bhandari ..... H04R 3/005 381/102
9,516,241 B2 * 12/2016 Kim ..... H04N 5/262
9,838,790 B2 * 12/2017 Palacino ..... H04R 5/027
2004/0032796 A1 * 2/2004 Chu ..... G01S 5/18 367/123
2005/0244018 A1 * 11/2005 Fischer ..... H04R 25/407 381/92
2008/0095384 A1 4/2008 Son et al.
2009/0323980 A1 * 12/2009 Wu ..... H04R 3/005 381/92
2011/0196522 A1 * 8/2011 Zakirov ..... H04S 7/305 700/94
2012/0087507 A1 * 4/2012 Meyer ..... H04R 27/00 381/56
2013/0166286 A1 6/2013 Matsumoto
2015/0340048 A1 * 11/2015 Shioda ..... G10L 21/02 704/225
2016/0277836 A1 * 9/2016 Palacino ..... H04R 3/005
2017/0003176 A1 * 1/2017 Phan Le ..... G01S 15/885
2017/0192080 A1 * 7/2017 Kwon ..... G01S 3/808

* cited by examiner

*Primary Examiner* — Khai N. Nguyen
(74) *Attorney, Agent, or Firm* — Norton Rose Fulbright US LLP

(57) ABSTRACT

Noise sources may be identified as either an interference source, such as a television, or a talker source by analyzing phase information of the microphone signals. A phase delay variance may be computed from pairs of microphone signals. A profile of an interference source may be learned over time by updating a stored profile when the phase delay variance is below a threshold. The stored profile may be used to identify interference sources received by the microphones by determining a correlation between the microphone signals and the stored profile. When an interference source is detected, control parameters may be generated to control a beamformer to reduce contribution of the interference source to an output audio signal. The output audio signal may be used for speech processing, such as in a smart home device.

20 Claims, 10 Drawing Sheets

TEMPORAL AND SPATIAL DETECTION OF ACOUSTIC SOURCES

FIELD OF THE DISCLOSURE

The instant disclosure relates to audio processing. More specifically, portions of this disclosure relate to far-field audio processing.

BACKGROUND

Far-field input in an audio system refers to an audio signal originating a far distance from the microphone(s). Far-field input may be from a person in a large room, a musician in a large hall, or a crowd in a stadium. Far-field input is contrasted by near-field input, which is an audio signal originating near the microphone(s). An example near-field input is a talker speaking into a cellular phone during a telephone call. Processing audio signals in the far field present additional challenges because the strength of an audio signal decays proportional to the distance of the source from the microphone. The farther a person is from a microphone, the quieter the person's voice is when it reaches the microphone. Furthermore, the presence of noise sources near the desired source can interfere with the person's voice. For example, a radio playing in the room that a person is talking makes the person difficult to hear. When the person is close to the microphone, such as in near-field processing, the person's voice is higher in amplitude than the radio. When the person is far from the microphone, such as in far-field processing, the person's voice is the same or lower in amplitude than the radio. Thus, the person's voice is more difficult to distinguish from the radio in far-field processing.

One use for far-field technology is in smart home devices. A smart home device is an electronic device configured to receive user speech input, process the speech input, and take an action based on the speech input. An example smart home device in a room is shown in FIG. 1. A living room 100 may include a smart home device 104. The smart home device 104 may include a microphone, a speaker, and electronic components for receiving speech input. Individuals 102A and 102B may be in the room and communicating with each other or speaking to the smart home device 104. Individuals 102A and 102B may be moving around the room, moving their heads, putting their hands over their face, or taking other actions that change how the smart home device 104 receives their voices. Also in the living room 100 may be sources of noise, audio signals that are not intended to activate the smart home device 104 or that interfere with the smart home device 104's reception of speech from individuals 102A and 102B. Some sources of noise include a television 110A and a radio 110B. Other sources of noise not illustrated may include washing machines, dish washers, sinks, vacuums, etc.

The smart home device 104 may incorrectly process voice commands because of the noise sources. Speech from the individuals 102A and 102B may not be recognizable by the smart home device 104 because the amplitude of noise drowns out the individual's speech. Additionally, speech from a noise source, such as television 110A, may be incorrectly recognized as a speech command. For example, a commercial on the television 110A may encourage a user to "buy product X" and the smart home device 104 may process the speech and automatically order product X. Additionally, speech from the individuals 102A and 102B may be incorrectly processed. For example, user speech for "buy backpacks" may be incorrectly recognized as "buy batteries" due to interference from the noise sources.

Shortcomings mentioned here are only representative and are included simply to highlight that a need exists for improved electrical components, particularly for audio processing employed in consumer-level devices, such as audio processing for far-field sounds in smart home devices. Embodiments described herein address certain shortcomings but not necessarily each and every one described here or known in the art. Furthermore, embodiments described herein may present other benefits than, and be used in other applications than, those of the shortcomings described above. For example, similar shortcomings may be encountered in other audio devices, such as mobile phones, and embodiments described herein may be used in mobile phones to solve such similar shortcomings as well as other shortcomings.

SUMMARY

Audio processing may be improved by techniques for processing microphone signals received by an electronic device. Two or more microphones may be used to record sounds from the environment, and the received sounds processed to obtain information regarding the environment. For example, audio signals from two or more microphones may be processed to identify noise sources in the far-field. The identified noise sources can be excluded from speech recognition processing to prevent accidental triggering of commands. The identification of the noise sources may also be used to filter the identified noise sources from the microphone signals to improve the recognition of desired speech.

Other information regarding the far-field may also be obtained from the microphone signals. For example, the microphone signals may be processed to identify a location of a talker. The location of the talker can be used to identify particular talkers and/or other characteristics of particular talkers. For example, the far-field processing may be used to differentiate between two talkers in a room and prevent confusion that may be caused by two active talkers. By improving these and other aspects of audio signal processing, far-field audio processing may be used to enhance smart home devices. Although examples using smart home devices are provided in the described embodiments, the far-field audio processing may enhance operation of other electronic devices, such as cellular phones, tablet computers, personal computers, portable entertainment devices, automobile entertainment devices, home entertainment devices. Furthermore, aspects of embodiments described herein may also be applied to near-field audio processing, and the described embodiments should not be considered to limit embodiments in accordance with the present disclosure to far-field audio processing.

Sound sources may be identified as either an interference source, such as a television, by analyzing phase information of the microphone signals. A phase delay variance may be computed from pairs of microphone signals. A profile of an interference source may be learned over time by updating a stored profile when the phase delay variance is below a threshold. The stored profile may be used to identify interference sources received by the microphones by determining a correlation between the microphone signals and the stored profile. When an interference source is detected, control parameters may be generated to control a beamformer to reduce contribution of the interference source to an output audio signal. The output audio signal may be used for speech processing, such as in a smart home device. The use of phase delay variance provides a technique for distinguishing acoustic sources regardless of content of the acoustic source. For example, speech from a television can be distinguished from speech from a talker using the described techniques involving phase delay variance.

Electronic devices incorporating functions for speech recognition, audio processing, audio playback, smart home automation, and other functions may benefit from the audio processing described herein. Hardware for performing the audio processing may be integrated in hardware components of the electronic devices or programmed as software or firmware to execute on the hardware components of the electronic device. The hardware components may include processors or other components with logic units configured to execute instructions. The programming of instructions to be executed by the processor can be accomplished in various manners known to those of ordinary skill in the art. Additionally or alternatively to integrated circuits comprising logic units, the integrated circuits may be configured to perform the described audio processing through discrete components, such as transistors, resistors, capacitors, and inductors. Such discrete components may be configured in various arrangements to perform the functions described herein. The arrangement of discrete components to perform these functions can be accomplished by those of ordinary skill in the art. Furthermore, discrete components can be combined with programmable components to perform the audio processing. For example, an analog-to-digital converter (ADC) may be coupled to a digital signal processor (DSP), in which the ADC performs some audio processing and the DSP performs some audio processing. The ADC may be used to convert an analog signal, such as a microphone signal, to a digital representation of sounds in a room. The DSP may receive the digital signal output from the ADC and perform mathematical operations on the digital representation to identify and/or extract certain sounds in the room. Such a circuit including analog domain components and digital domain components may be referred to as a mixed signal circuit, wherein "mixed" refers to the mixing of analog and digital processing.

In some embodiments, the mixed signal circuit may be integrated as a single integrated circuit (IC). The IC may be referred to as an audio controller or audio processing because the IC is configured to process audio signals as described herein and is configured to provide additional functionality relating to audio processing. However, an audio controller or audio processor is not necessarily a mixed signal circuit, and may include only analog domain components or only digital domain components. For example, a digital microphone may be used such that the input to the audio controller is a digital representation of sounds and analog domain components are not included in the audio controller. In this configuration, and others, the integrated circuit may have only digital domain components. One example of such a configuration is an audio controller having a digital signal processor (DSP). Regardless of the configuration for processing far-field audio, the integrated circuit may include other components to provide supporting functionality. For example, the audio controller may include filters, amplifiers, equalizers, analog-to-digital converters (ADCs), digital-to-analog converters (DACs), a central processing unit, a graphics processing unit, a radio module for wireless communications, and/or a beamformer. The audio may be used in electronic devices with audio outputs, such as music players, CD players, DVD players, Blu-ray players, headphones, portable speakers, headsets, mobile phones, tablet computers, personal computers, set-top boxes, digital video recorder (DVR) boxes, home theatre receivers, infotainment systems, automobile audio systems, and the like.

In embodiments described herein, "far-field audio processing" may refer to audio processing for "far-field" audio sources, where "far field" refers to a distance away from a microphone such that a wave front of an audio pressure wave is generally flat.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1:
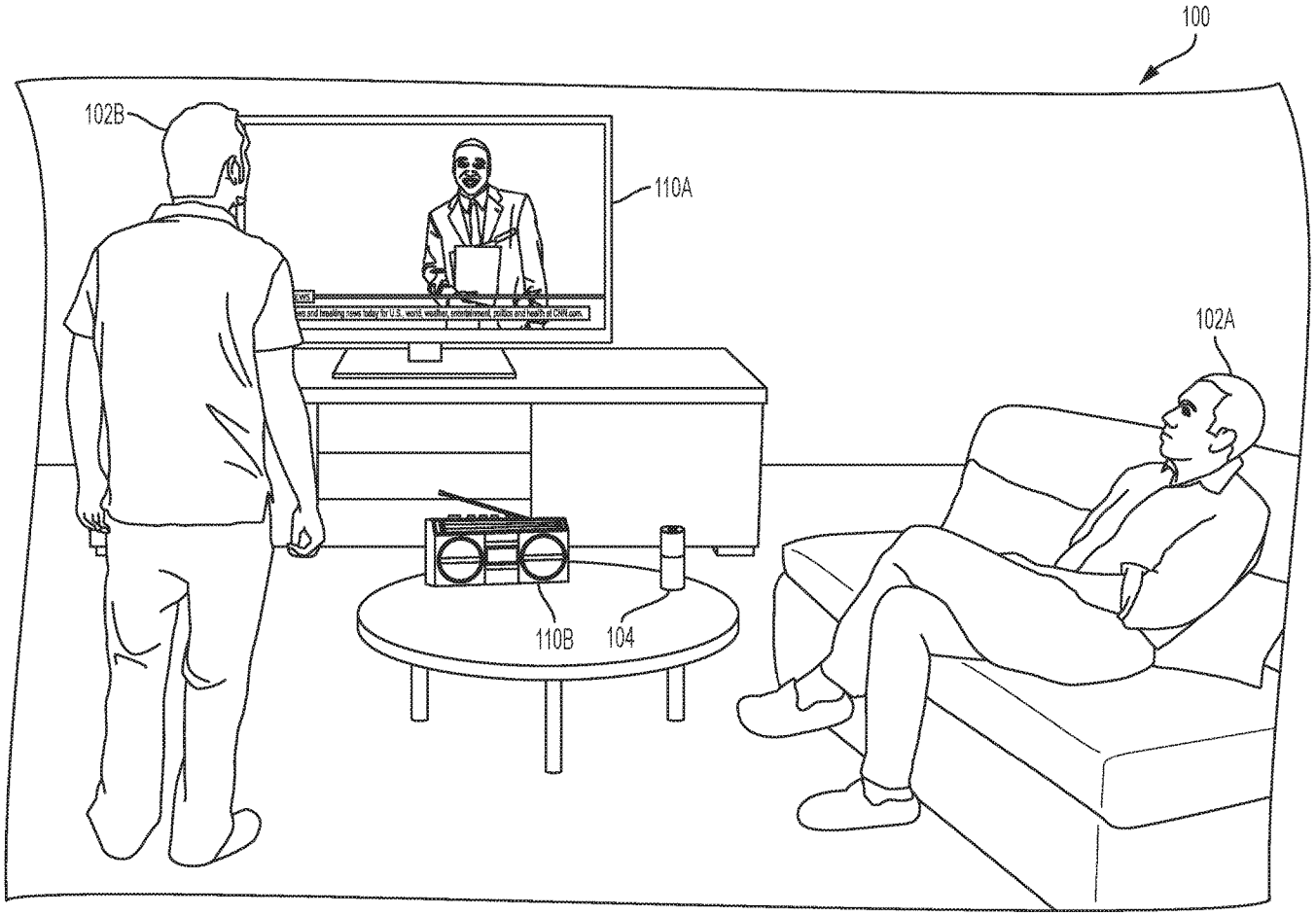
FIG. 1 PRIOR ART
FIG. 1 is an illustration of a conventional smart home device in a room.
Figure 2:
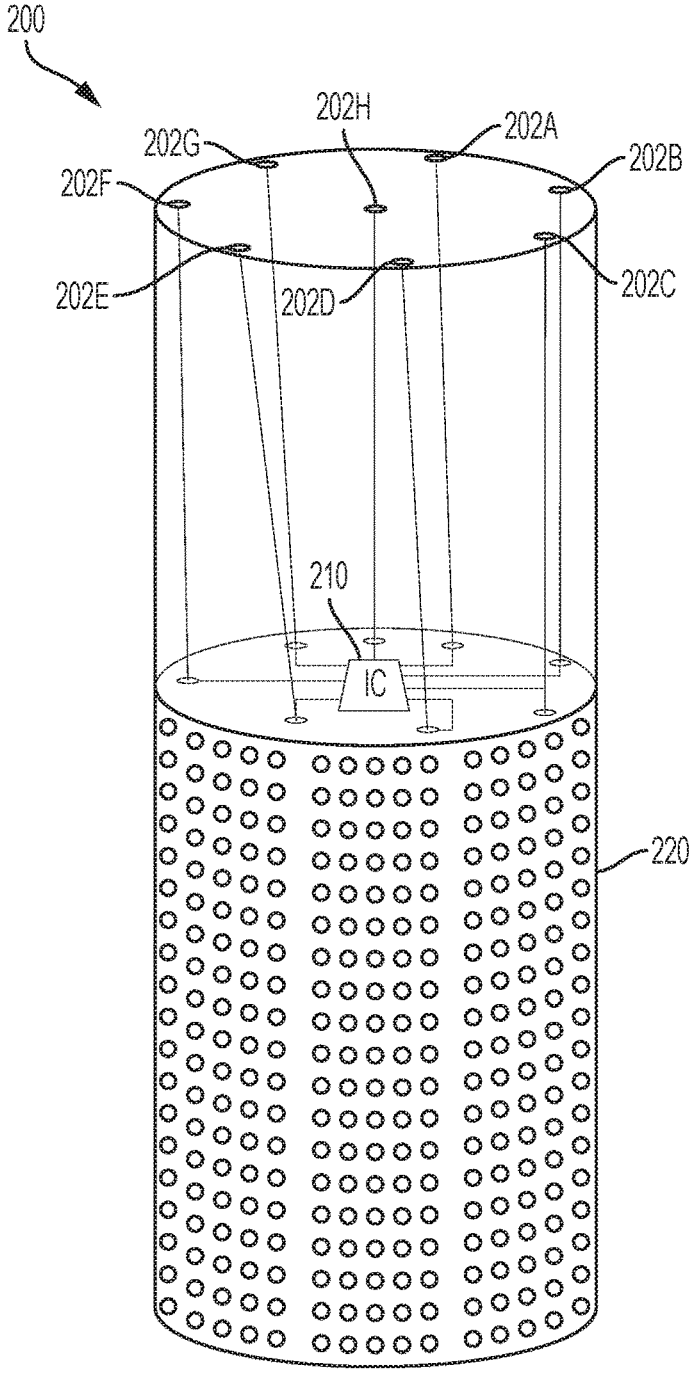
FIG. 2 is a perspective view of a smart home device with components used for audio processing according to some embodiments of the disclosure.

Far-field audio processing may use microphone signals from two or more microphones of an electronic device. An electronic device, such as smart home device 200, may include a microphone array 202 including microphones 202A-G. The microphones 202A-G may be any microphone device that transduces pressure changes (such as created by sounds) into an electronic signal. One example device is a miniature microphone, such as a micro-electro-mechanical system (MEMS) microphone. Another example is a digital microphone (DMIC). The microphones 202A-G may be arranged at different locations of the smart home device 200. The different positions result in each of the microphones 202A-G receiving different audio signals at any moment in time. Despite the difference, the audio signals are related as coming from the same environment and the same sound sources in the environment. The similarity and the difference of the audio signals may be used to derive characteristics of the environment and/or the sound sources in the environment.

An integrated circuit (IC) 210 may be coupled to the microphones 202A-G and used to process microphone signals produced by the microphones 202A-G. The IC 210 performs functions of the far-field audio processing, such as described in the embodiments of FIG. 7 and FIG. 8. The output of the IC 210 may vary in different embodiments based on a desired application. In smart home device 200, the IC 210 may output a digital representation of audio received through the microphones 202A-G and processed according to embodiments of the invention. For example, processing of the microphone signals may result in a single output audio signal containing an enhanced signal-to-noise ratio that allows for more accurate and reliable speech detection. The output audio signal may be encoded in a file format, such as MPEG-1 Layer 3 (MP3) or Advanced Audio Coding (AAC) and communicated over a network to a remote device in the cloud. The remote device may perform speech recognition on the audio file to recognize a command in the speech and perform an action based on the command. The IC 210 may receive an instruction from the remote device to perform an action, such as to play an acknowledgement of the command through a speaker 220. As another example, the IC 210 may receive an instruction to play music, either from a remote stream or a local file, through the speaker 220. The instruction may include an identifier of a station or song obtained through speech recognition performed on the audio signal obtained using the far-field audio processing of the invention.

The microphones 202A-H are illustrated as integrated in a single electronic device in example embodiments of the present disclosure. However, the microphones may be in other electronic devices. For example, in some embodiments, the microphones 202A-H may be in discrete devices around the living room. Those discrete devices may wirelessly communicate with the smart home device 200 through a radio module in the discrete device and the smart home device 200. Such a radio module may be a RF device operating in the unlicensed spectrum, such as a 900 MHz RF radio, a 2.4 GHz or 5.0 GHz WiFi radio, a Bluetooth radio, or other radio modules.

Figure 3:
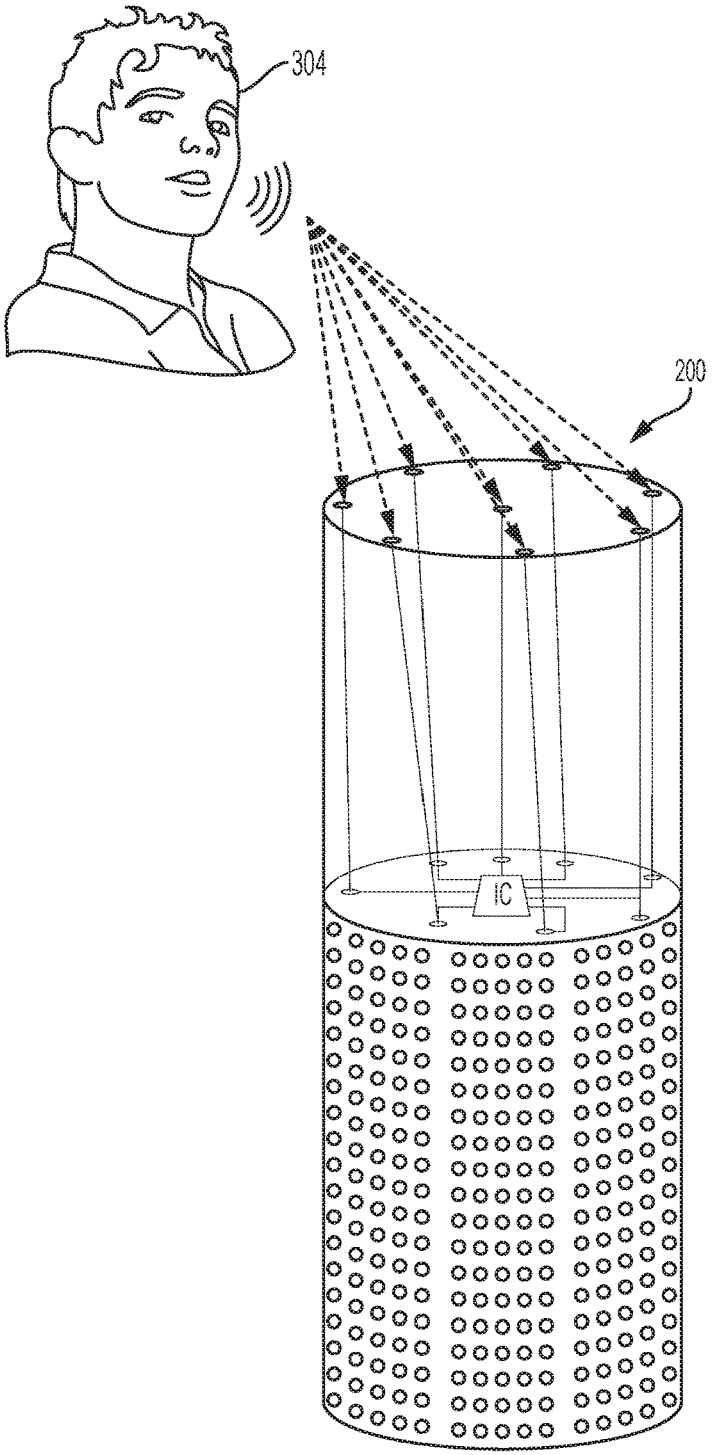
FIG. 3 is an illustration of different times of arrival of audio at two or more microphones according to some embodiments of the disclosure.

Microphones 202A-H sense pressure changes resulting from a sound in the environment at different times, because each microphone has a different position relative to the source of the sound. These different times are illustrated in FIG. 3. A talker 304 may speak towards the microphones 202A-H. The distance from the talker's 304 mouth to each of the microphones 202A-H is different, resulting in each of the microphones 202A-H recording the sound at a different time. Other than this difference, the audio signals received at each of the microphones 202A-H may be very similar because all of the microphones 202A-H are recording the same sounds in the same environment.

Figure 4:
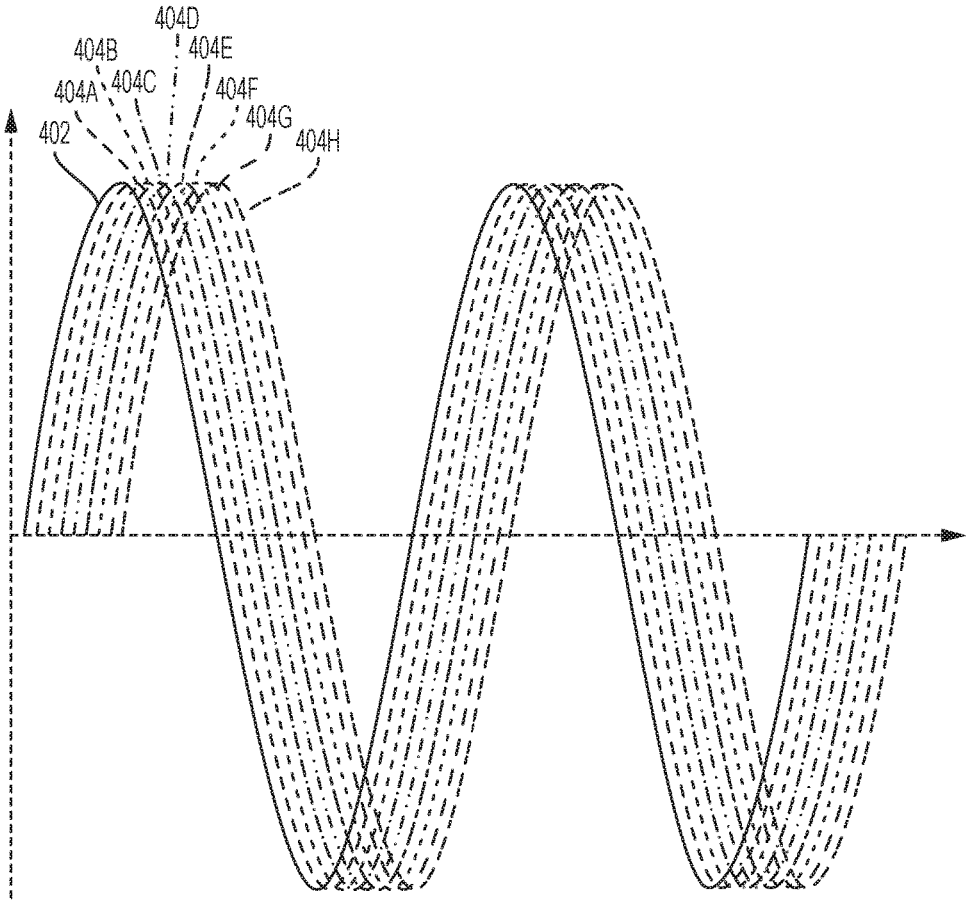
FIG. 4 is a graph illustrating microphone signals from an array of microphones at different locations on an electronic device according to some embodiments of the disclosure.

The similarity and difference in the audio signals received by each of the microphones is reflected in the different microphone inputs received at the IC 210 from each of the microphones 202A-H. FIG. 4 is a graph illustrating microphone signals from an array of microphones at different locations on an electronic device, which may be used in some embodiments of the disclosure. A sound in an environment creates a pressure wave that spreads throughout the environment and decays as the wave travels. An example measurement of the pressure wave at the location of the sound is shown as signal 402. Each of the microphones 202A-H receives the signal 402 later as the sound travels through the environment and reaches each of the microphones 202A-H. The closest microphone, which may be microphone 202A, receives signal 404A. Signal 404A is shown offset from the original signal 402 by a time proportional to the distance from the source to the microphone 202A. Each of the other microphones 202B-H receives the sound at a slightly later time as shown in signals 404B—H based on each of the microphones 202B-H distance from microphone 202A.

Each of the signals 404A-H generated by microphones 202A-H may be processed by IC 210. IC 210 may calculate signal characteristics, such as phase delay, between each of the pairs of microphones. For example, a phase delay may be calculated between the signal 404A and 404B corresponding to microphones 202A and 202B, respectively. The phase delay is proportional to the timing difference between the signal 404A and 404B. Phase delays may be calculated for other pairs of microphones, such as between 404A-C, 404A-D, 404A-E, 404A-F, 404A-G, and 404A-H, likewise for 404B-C, 404B-D, 404B-E, 404B-F, 404B-G, 404B-H, and likewise for other pairs of microphones. The phase delay information may be processed in far-field audio processing to improve speech recognition, particularly in noisy environments.

Figure 5:
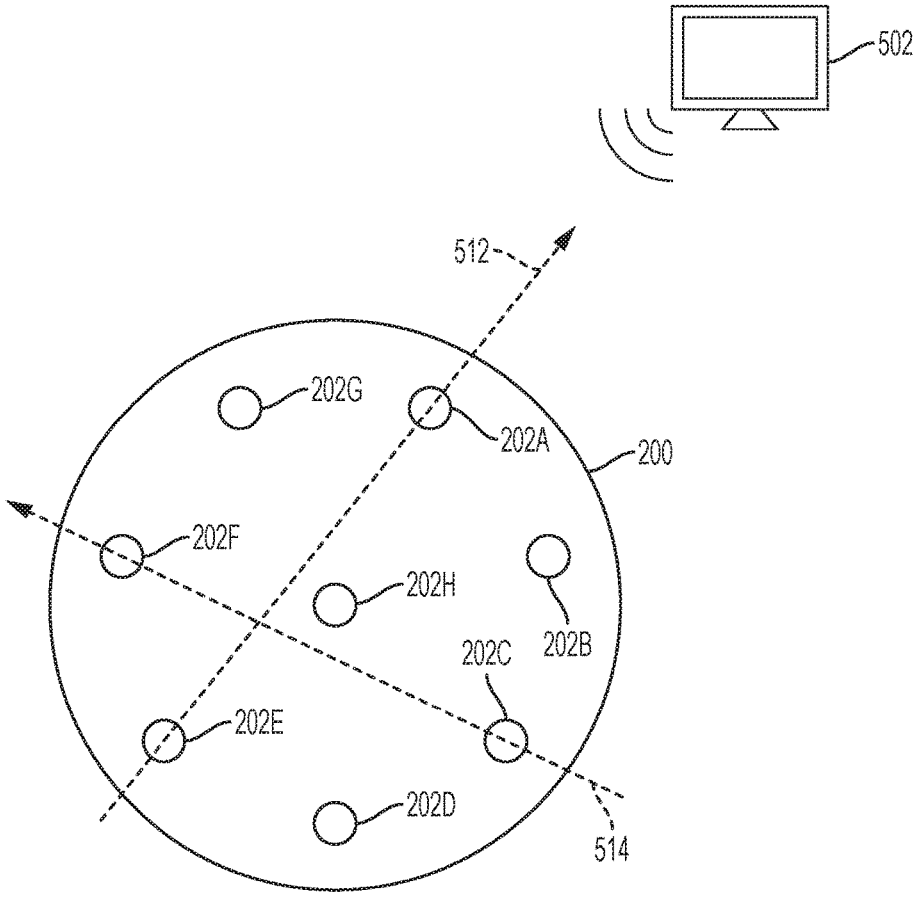
FIG. 5 is an illustration of phase difference between pairs of microphones in the array according to some embodiments of the disclosure.

The phase delay may be processed to identify characteristics of acoustic sources. Movement of acoustic sources may be used to determine if the acoustic source is noise. Processing may include computation of a phase delay between pairs of microphones and comparison of the phase delays to identify a relative location. The pair of microphones aligned along a vector pointing in the direction of a sound source will have a larger phase delay than the pair of microphones aligned along an orthogonal vector in the direction of the sound source. FIG. 5 is an illustration of phase delay between pairs of microphones in the array according to some embodiments of the disclosure. A television 502 may be in a direction along a vector 512 oriented from microphone 202A to microphone 202E. A phase delay calculated between the pair of microphones 202A and 202E for the television 502 may be the largest phase delay of any pairs of the microphones 202A-H. A phase delay calculated between the pair of microphones 202C and 202F along a vector 514 for the television 502 may be the smallest phase delay of any pairs of the microphones 202A-H. The relative location of other sound sources may likewise be determined around the smart home device 200 by computing phase delay between pairs of microphones. Stationary sources, such as television 502, may appear as a sound source with an approximately constant phase delay profile. Moving sources, such as individuals, may appear as a sound source with a changing phase delay profile. Stationary sources may be differentiated from moving sources through processing of the phase delays profiles.

Sound sources, even when physically stationary, may play content like that of a talker. For example, a television may play a news or other program that includes speech. Smart home devices may be unable to discriminate between such an interference source's speech and a desired talker speech. Processing of signals from the microphone array may allow detection of whether an acoustic source is an interference source or a talker source without any prior assumption on the spatial properties of acoustic source. In some embodiments, the processing may operate on both spatial and temporal stationarity properties of the acoustic sources. A detector implementing such a method may be referred to as a Spatio-Temporal Stationarity (STS) Voice Activity Detector (VAD).

Speech signals originating from a human talker are usually not both spatially and temporally stationary for more than a few seconds. Speech signals are not temporally stationary because of pauses between phonemes and words of speech. These pauses can be measured by inter-microphone coherence phase changes between speech present and speech absent frames. Furthermore, speech from a moving talker cannot have a fixed phase as changes in spatial propagation of sound affect the phase between two microphones in the microphone array. This effect is noticeable even with a spatially stationary talker because head movements while a person talks introduce variance into the coherence phase. In contrast, many interference sources in home environments, such as TV, music system or dishwasher, show both spatial and temporal stationarity, and thus can be distinguished from talker sources. For example, consider a TV at home playing music. The TV is spatially fixed, and there may be some segments in music signals in which there are no pauses for more than few seconds. The phase of the microphone pair coherence does not change due to both spatial and temporal stationarity of the TV. The interference signals can be detected by, for example, searching for a local minimum in the temporal variance of the phase normalized over frequency bins and buffered for few seconds. These minimums usually will happen in segments of TV that there is no speech-like content, and the signal is stationary or semi-stationary. After this initial TV detection, the smart home device may learn the coherence phase of the interference signal. The TV or other system is spatially fixed, and thus the phase will not change over time. For subsequent frames after learning the coherence phase, only the similarity of that frame's phase with the learned interference phase may be checked. This similarity, obtained as a correlation coefficient of each input frame's phase and the learned interference phase in different sub-bands, may be referred to as an STS statistic. The temporal characteristic of the TV signal is not important because the phase of the microphone is independent of its content. A trained detector may then process various types of content including highly non-stationary signals (e.g., news and ads).

Figure 6:
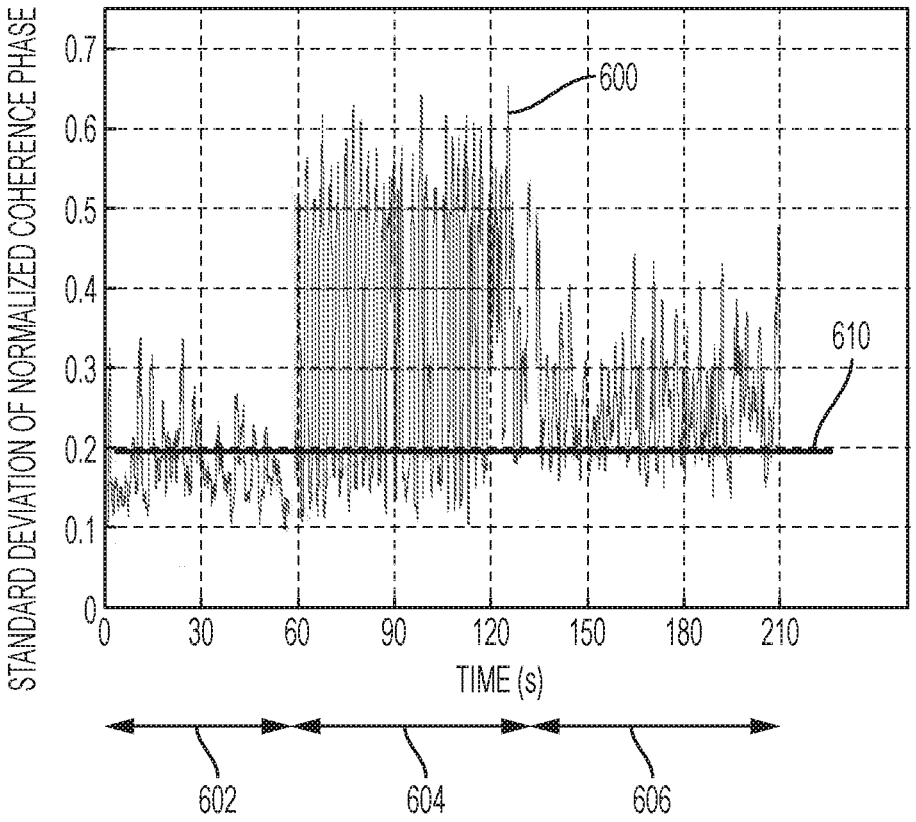
FIG. 6 is a graph illustrating an example standard deviation of normalized coherence phase for distinguishing between interference and talker sources according to some embodiments of the disclosure.

The use of coherence phase in distinguishing interference sources from talker sources is illustrated in FIG. 6. FIG. 6 is a graph illustrating an example standard deviation of normalized coherence phase for distinguishing between interference and talker sources according to some embodiments of the disclosure. A pair of microphone signals received by microphones of a microphone array may be processed to obtain a standard deviation of normalized coherence phase value shown in line 600. During time 602, the microphones are receiving a television signal with speech content. During time 604, the microphones are receiving audio from a talker. During time 606, the microphones are receiving audio from both a television signal with speech content and a talker. The coherence phase during time 602 is more static than the coherence phase during time 604. This difference may be distinguishable during processing of the microphone signals and used to identify an acoustic source as an interference source, during time 602, or a talker source, during time 604. The coherence phase values may be computed for individual frames from the microphone signals or for a plurality of frames buffered from the microphone signals. The coherence phase shown in line 600 is computed for a three-second buffered input. The interference phase profile is updated for frames in which the standard deviation of normalized coherence phase is below a pre-set threshold value 610.

Figure 7:
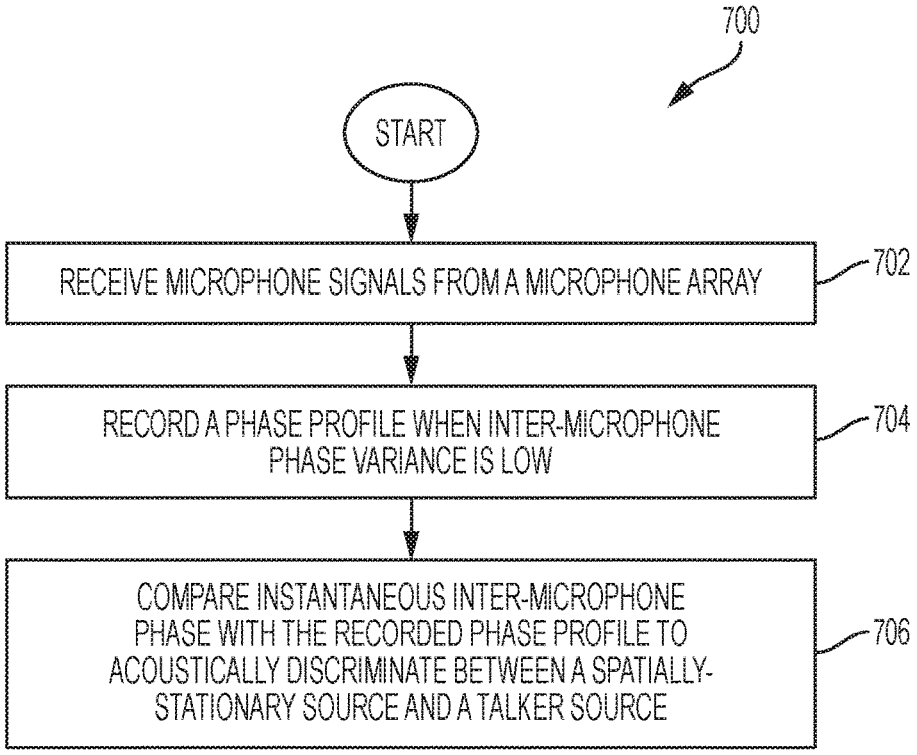
FIG. 7 is a flow chart illustrating an example method for distinguishing acoustic sources based on phase variance according to embodiments of the disclosure.

One method for processing microphone signals to distinguish acoustic sources is illustrated in FIG. 7. FIG. 7 is a flow chart illustrating an example method for distinguishing acoustic sources based on phase variance according to embodiments of the disclosure. A method 700 may begin at block 702 with receiving microphone signals from a microphone array. At block 704, a phase profile is recorded or updated when inter-microphone phase variance is below a threshold value. Then, at block 706, instantaneous values of inter-microphone phase may be compared to the recorded phase profile to acoustically discriminate between a spatially-stationary source and a talker source.

Figure 8:
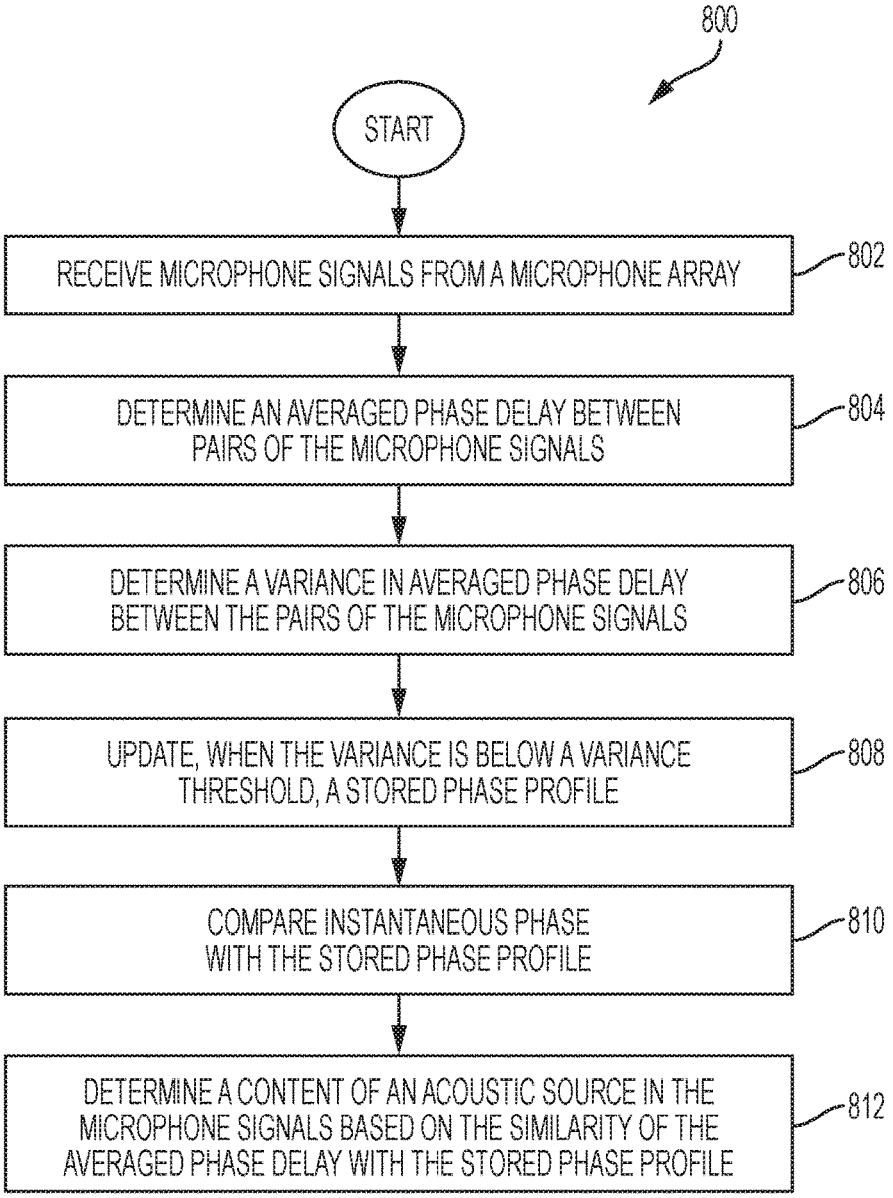
FIG. 8 is a flow chart illustrating an example method for distinguishing acoustic sources based on phase variance according to some embodiments of the disclosure.

One embodiment of the method of FIG. 7 is illustrated in FIG. 8. FIG. 8 is a flow chart illustrating an example method for distinguishing acoustic sources based on phase variance according to some embodiments of the disclosure. The method 800 may begin at block 802 with receiving microphone signals from a microphone array. Then, at block 804, an averaged phase delay may be determined between pairs of the microphone signals. The averaged phase delay may be computed as mean(phase/(2*pi*f)), where the phase delay is a vector representing a cross-power spectrum between two microphone signals and phase delay is a scalar value representing an average of sample delay over frequency bins of the microphone signals. Next, at block 806, a variance in the averaged phase delay may be determined for pairs of microphone signals. Then, at block 808, a stored phase profile may be updated when the determined variance of block 806 is below a threshold variance value. Next, at block 810, the instantaneous phase may be compared with the stored phase profile, at block 812, to determine a content of an acoustic source in the microphone signals based on the similarity of the phase with the stored phase profile.

Figure 9:
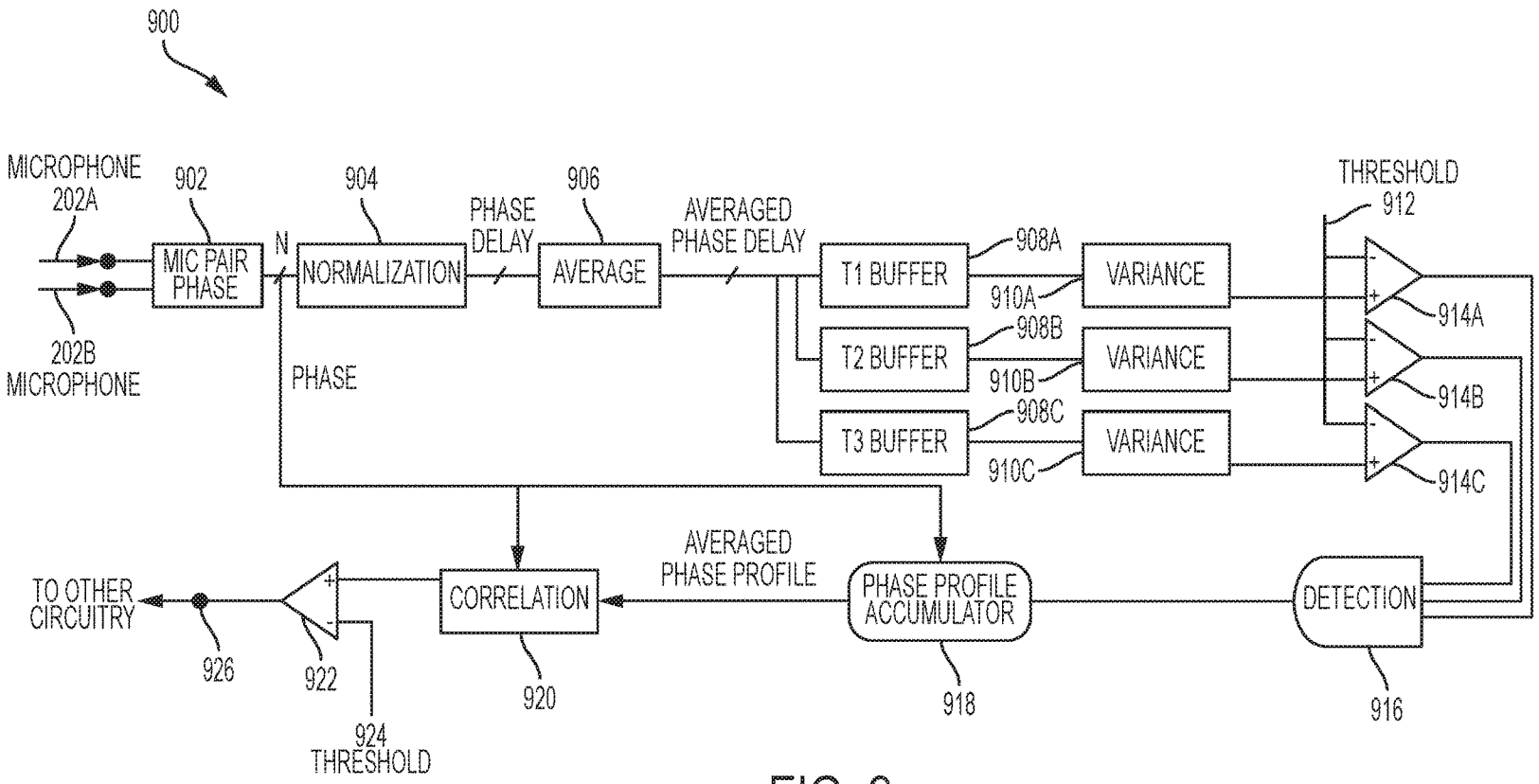
FIG. 9 is a block diagram illustrating a system for distinguishing acoustic sources based on phase variance according to some embodiments of the disclosure.

Determination of the acoustic source based on coherence phase values may be implemented in a system for processing the microphone signals. One example system is illustrated in FIG. 9. FIG. 9 is a block diagram illustrating a system for distinguishing acoustic sources based on phase variance according to some embodiments of the disclosure. Signals from microphones 202A and 202B may be received by a microphone pair phase computation block 902. The phase may be normalized by frequency at block 904 and averaged across frequency sub-bands at block 906 to generate a single value called phase delay. That value may be passed through one or more buffers 908A, 908B, and 908C. The buffers 908A, 908B, and 908C may buffer for different periods of time, such as 1 second, 0.5 seconds, and 0.25 seconds, respectively. The buffered data in buffers 908A-C may be processed in blocks 910A-C to determine a variance of the buffered data. The variance values from blocks 910A-C may be compared to a threshold value 912 at blocks 914A-C, respectively. An AND gate 916, or other logic circuitry, may receive the output of the comparisons in blocks 914A-C and determine whether to update a stored phase profile used to generate the threshold for blocks 914A-C. If the variance is below the threshold amount, the phase profile accumulator 918 block is activated to update a stored phase profile using data from the block 902. A correlation is computed at block 920 to determine if the instantaneous phase profile from block 902 is similar to the stored phase profile of block 918. A detection statistic may be output from block 920, with the detection statistic indicating a probability that the microphone signals include an interference source or a talker source. A threshold 924 may be compared with the detection statistics value at block 922 to determine whether the microphone signals are indicative of an interference source or a talker source. The determination may be output at output node 926 as, for example, a binary value or a decimal value between 0 and 1 indicating a probability of the acoustic source being an interference source.

Figure 10:
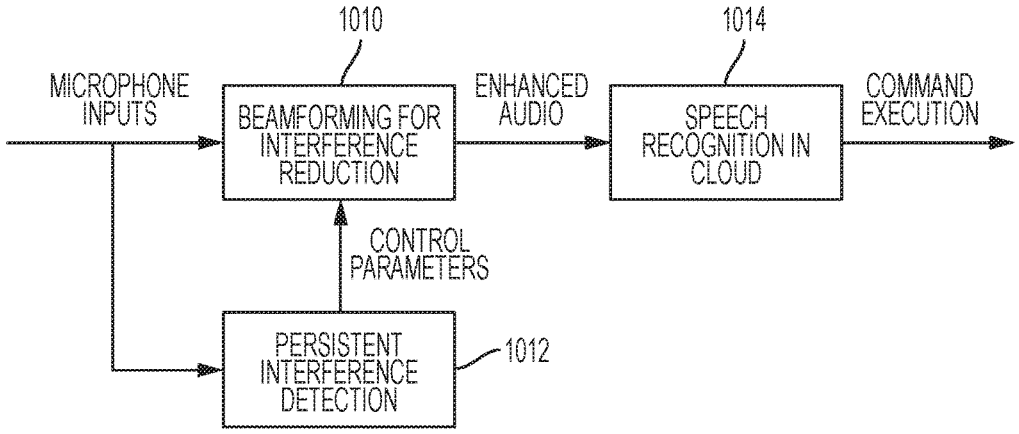
FIG. 10 is a block diagram illustrating an example beamformer according to some embodiments of the disclosure.

The functionality described for detecting persistent interference sources may be incorporated into a beamformer controller of an audio processing integrated circuit or other integrated circuit. The beamformer controller may use an interference determination, such as an interference detection statistic, to modify control parameters for a beamformer that processes audio signals from the microphone array. The beamformer processing generates an enhanced audio output signal by reducing the contribution of the interference sources, which improves voice quality and allows for more accurate and reliable automatic recognition of speech commands from the desired talker by a remote device in the cloud. FIG. 10 is a block diagram illustrating an example beamformer controller according to some embodiments of the disclosure. Microphones provide input signals to a beamformer 1010. The beamformer 1010 may operate using control parameters, such as a desired talker speech step size and an interference step size, derived from persistent interference detection results at block 1012. Enhanced audio produced by the beamformer 1010 may be sent to a remote system in cloud 1014 for automatic speech recognition or other processing. The remote system in cloud 1014 recognizes a command from the enhanced audio and may execute the command or send the command back to the smart home device for execution.

Spatio-Temporal Stationarity (STS) Voice Activity Detection (VAD) incorporated in a multiple-microphone adaptive beamformer framework can reduce noise without affecting speech, while remaining independent of content. For example, the algorithm may allow speech determination when the algorithm has previously been exposed to non-speech-like content (e.g. movie, music, sports, etc.). Acceptable detection of the interference source and the talker source may be performed independent of their (relative) locations.

The schematic flow chart diagrams of FIG. 7 and FIG. 8 are generally set forth as a logical flow chart diagram. Likewise, other operations for the circuitry are described without flow charts herein as sequences of ordered steps. The depicted order, labeled steps, and described operations are indicative of aspects of methods of the invention. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The operations described above as performed by a controller may be performed by any circuit configured to perform the described operations. Such a circuit may be an integrated circuit (IC) constructed on a semiconductor substrate and include logic circuitry, such as transistors configured as logic gates, and memory circuitry, such as transistors and capacitors configured as dynamic random access memory (DRAM), electronically programmable read-only memory (EPROM), or other memory devices. The logic circuitry may be configured through hard-wire connections or through programming by instructions contained in firmware. Further, the logic circuitry may be configured as a general-purpose processor (e.g., CPU or DSP) capable of executing instructions contained in software. The firmware and/or software may include instructions that cause the processing of signals described herein to be performed. The circuitry or software may be organized as blocks that are configured to perform specific functions. Alternatively, some circuitry or software may be organized as shared blocks that can perform several of the described operations. In some embodiments, the integrated circuit (IC) that is the controller may include other functionality. For example, the controller IC may include an audio coder/decoder (CODEC) along with circuitry for performing the functions described herein. Such an IC is one example of an audio controller. Other audio functionality may be additionally or alternatively integrated with the IC circuitry described herein to form an audio controller.

If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

The described methods are generally set forth in a logical flow of steps. As such, the described order and labeled steps of representative figures are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. For example, although digital signal processors (DSPs) are described throughout the detailed description, aspects of the invention may be implemented on other processors, such as graphics processing units (GPUs) and central processing units (CPUs). Where general purpose processors are described as implementing certain processing steps, the general purpose processor may be a digital signal processors (DSPs), a graphics processing units (GPUs), a central processing units (CPUs), or other configurable logic circuitry. As another example, although processing of audio data is described, other data may be processed through the filters and other circuitry described above. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method, comprising:

receiving a first microphone signal and a second microphone signal;

determining an averaged phase delay between the first microphone signal and the second microphone signal;

determining a variance in the averaged phase delay between the first microphone signal and the second microphone signal;

updating, when the variance is below a variance threshold, a stored phase profile;

comparing an instantaneous phase corresponding to the first microphone signal and the second microphone signal with the stored phase profile; and determining a content of the first microphone signal and the second microphone signal based, at least in part, on a similarity of the instantaneous phase with the stored phase profile.

2. The method of claim 1, wherein the step of determining the content comprises determining whether the content includes an interference source or a talker source.

3. The method of claim 2, wherein the step of determining the content comprises determining the content is an interference source when the instantaneous phase between the first microphone signal and the second microphone signal is similar to the stored phase profile.

4. The method of claim 3, wherein the step of determining the content is an interference source comprises identifying a spatially stationary interference source.

5. The method of claim 3, wherein the step of determining the content comprises comparing the instantaneous phase at each of a plurality of frequency sub-bands with the stored averaged phase profile.

6. The method of claim 1, further comprising: receiving a third microphone signal; repeating the step of determining the variance in the averaged phase delay for additional pairs of microphone signals of the first microphone signal, the second microphone signal, and the third microphone signal; repeating the step of comparing the determined variance with the variance threshold for the determined variance of each pair of microphone signals; and determining a content of the first microphone signal, the second microphone signal, and the third microphone signal based, at least in part, on the comparison of the phase between the microphones with the stored phase profile for each pair of microphone signals.

7. The method of claim 1, further comprising outputting parameters to a beamformer that modify the processing of the first microphone signal and the second microphone signal by the beamformer to reduce contribution from an interference source from the first microphone signal and the second microphone signal.

8. An apparatus, comprising:

an audio controller configured to perform steps comprising:

receiving a first microphone signal and a second microphone signal;

determining an averaged phase delay between the first microphone signal and the second microphone signal;

determining a variance in the averaged phase delay between the first microphone signal and the second microphone signal;

updating, when the variance is below a variance threshold, a stored phase profile;

comparing an instantaneous phase corresponding to the first microphone signal and the second microphone signal with the stored phase profile; and determining a content of the first microphone signal and the second microphone signal based, at least in part, on a similarity of the instantaneous phase with the stored phase profile.

9. The apparatus of claim 8, wherein the audio controller is configured to determine the content by determining whether the content includes an interference source or a talker source.

10. The apparatus of claim 9, wherein the audio controller is configured to determine the content is an interference source by identifying a spatially stationary interference source.

11. The apparatus of claim 8, wherein the audio controller is further configured to output parameters to a beamformer that modify the processing of the first microphone signal and the second microphone signal by the beamformer to reduce contribution from an interference source from the first microphone signal and the second microphone signal.

12. An apparatus, comprising:

a first input node and a second input node for receiving input microphone signals;

a phase delay variance block coupled to the first input node and the second input node and configured to compute a phase delay variance of the input microphone signals;

a detection block coupled to the phase delay variance block and configured to determine a presence of an interference source based, at least in part, on the phase delay variance.

13. The apparatus of claim 12, further comprising a phase delay computation block coupled between the phase delay variance block and the first input node and the second input node, wherein the phase delay computation block is configured to generate a phase delay difference for a plurality of frequency sub-bands; normalize the phase delay difference; and average values over the plurality of frequency sub-bands to obtain an averaged phase delay value, wherein the phase delay variance block is configured to compute the phase delay variance based, at least in part, on the averaged phase delay value.

14. The apparatus of claim 12, further comprising a second phase delay variance block configured to compute a second phase delay variance based, at least in part, on a first buffered phase delay value.

15. The apparatus of claim 12, further comprising a third phase delay variance block configured to compute a third phase delay variance based, at least in part, on a second buffered phase delay value, wherein the second buffered phase delay value is buffered for a period of time longer than the first buffered phase delay value.

16. The apparatus of claim 12, further comprising a phase profile accumulator coupled to the detection block, wherein the phase profile accumulator is configured to store a phase profile of the input microphone signals.

17. The apparatus of claim 16, wherein the phase profile accumulator is configured to update the stored phase profile when the phase delay variance is below a threshold level.

18. The apparatus of claim 16, wherein the detection block is configured to determine a presence of an interference source by comparing an instantaneous phase with the stored phase profile.

19. The apparatus of claim 12, further comprising a beamform controller configured to generate step size control parameters based, at least in part, on the determination of a presence of an interference source by the detection block.

20. The apparatus of claim 19, further comprising a beamformer coupled to the beamform controller and configured to process the input microphone signals based, at least in part, on the step size control parameters to reduce a contribution of the interference source to an audio output.

* * * * *